US005170895A

United States Patent [19]

Chudzik

[11] Patent Number: 5,170,895

[45] Date of Patent: Dec. 15, 1992

[54] FILE SUSPENSION ASSEMBLY AND SPRING CLIP THEREFOR

[76] Inventor: Richard W. Chudzik, 124 Oak Ridge Dr., Burr Ridge, Ill. 60521

[21] Appl. No.: 686,396

[22] Filed: Apr. 18, 1991

[51] Int. Cl.[5] ..... A47F 7/00

[52] U.S. Cl. ..... 211/46; 312/184

[58] Field of Search ..... 211/45, 46, 189; 312/184

[56] References Cited

U.S. PATENT DOCUMENTS

| | | | |
|---|---|---|---|
| 2,852,028 | 9/1958 | Patterson et al. | 312/184 X |
| 3,295,697 | 1/1967 | Patterson | 312/184 X |
| 3,356,228 | 12/1967 | Woodhouse | 211/45 |
| 3,999,663 | 12/1976 | Walter et al. | 312/184 X |
| 4,091,933 | 5/1978 | Alexander | 211/46 X |

*Primary Examiner*—Alvin C. Chin-Shue
*Assistant Examiner*—Sarah A. Lechok
*Attorney, Agent, or Firm*—Tilton Fallon Lungmus

[57] ABSTRACT

A file folder suspension assembly that may be assembled and disassembled without the use of tools. The assembly includes a pair of spaced, parallel, file-suspension rails and two end frames supporting such rails at their opposite ends. Each end frame has a pair of upstanding side bars and a horizontal spreader bar, and spring metal clips tightly and securely connect together the ends of the spreader and side bars, and the ends of the rails, at four corners of the assembly. Each spring clip is generally S-shaped with aligned openings in the base and intermediate portions thereof for receiving the upper ends of said side bars and with the ends of the file suspension rails gripped securely between such portions. An opening is also provided by each clip for receiving an end portion of a spreader bar for supporting the same in contact with the upper end portion of a side bar.

17 Claims, 2 Drawing Sheets

FILE SUSPENSION ASSEMBLY AND SPRING CLIP THEREFOR

BACKGROUND AND SUMMARY

In the file folder suspension systems most commonly in use, tools are required to assemble (or disassemble) the parts. For example, FIG. 1 depicts a conventional assembly 10 in which a pair of side rails 11 are supported at each of their ends by an end frame 12. Each end frame includes a lower portion with upstanding arms 12*a* and a spreader bar 12*b*, and screws 13 extend through threaded openings of the two parts to clamp the ends of the rails 11 in the manner shown in the drawing. While such a construction is effective and relatively inexpensive, its assembly and diassembly require the use of tools such as a screwdriver and/or wrench. Economy is therefore achieved at the cost of inconvenience.

Systems are known in which end frames and rails may be assembled without the use of tools. In U.S. Pat. No. 4,176,753, end frames are U-shaped in configuration and plastic corner fittings 22 are secured to the upstanding side bars of those frames. Side rails may be snapped into position between the jaws of the corner fittings and spreader tubes then inserted into openings in the back wall of each fitting to engage bosses provided by those fittings.

While such a system eliminates screws and the need for tools, it is relatively expensive to manufacture, especially if the molded (or cast) corner fittings must be pre-assembled with the end frames during such manufacture. Also, the attachment between the corner fittings and the upright bars and spreader tubes may present problems since no tightening of the connections between the parts occurs during or following assembly. Should upward forces, or lateral forces, be exerted on the side rails following assembly, such fittings might become disengaged from the bars of the end frames or from the horizontal spreader tubes.

Accordingly, it is an object of this invention to provide a system that eliminates the use of screws and tools but is self-tightening in operation so that problems of inadvertent disassembly in later use are avoided or greatly reduced. It is also an object to provide a system that is relatively inexpensive and to manufacture and which requires no pre-assembly of parts.

In brief, the assembly utilizes spring metal clips at each of its four corners for securely holding together the side rails and the upstanding side bars of the end frames of that assembly. Each clip is generally S-shaped in configuration and may be inexpensively stamped from spring metal stock. The intermediate and base portions of each S-shaped clip have aligned openings for receiving an upper end of a side bar of an end frame. Subsequent insertion of the end of a file-suspension rail between the intermediate and lower portions of a clip causes those portions to flex away from each other and tightly grip both the rail and the upper end of the side bar that projects through the aligned openings.

The spring clips are also provided with openings for receiving the ends of spreader bars which engage the upper ends of the upstanding side bars and which complete the end frame assembly at each end of the structure. The top portion of each S-shaped clip extends over the contacting ends of the spreader and side bars to conceal such portions and also engages the side bars to insure against any possibility of the clips shifting downwardly along those side bars when the structure is in use.

To retain the side rails in place, each clip has its base portion provided with an upstanding flange and its intermediate portion with a depending projection. The upper edge of each rail is wedged tightly between the projection and the upper end of a side bar extending through the aligned openings of the clip and, ideally, the parts are constructed and arranged so that the side rail slopes upwardly and inwardly into tight wedging contact with the side bar.

Other features, advantages, and objects will become apparent from the specification and drawings.

DRAWINGS

DESCRIPTION OF PREFERRED EMBODIMENTS

Figure 3:
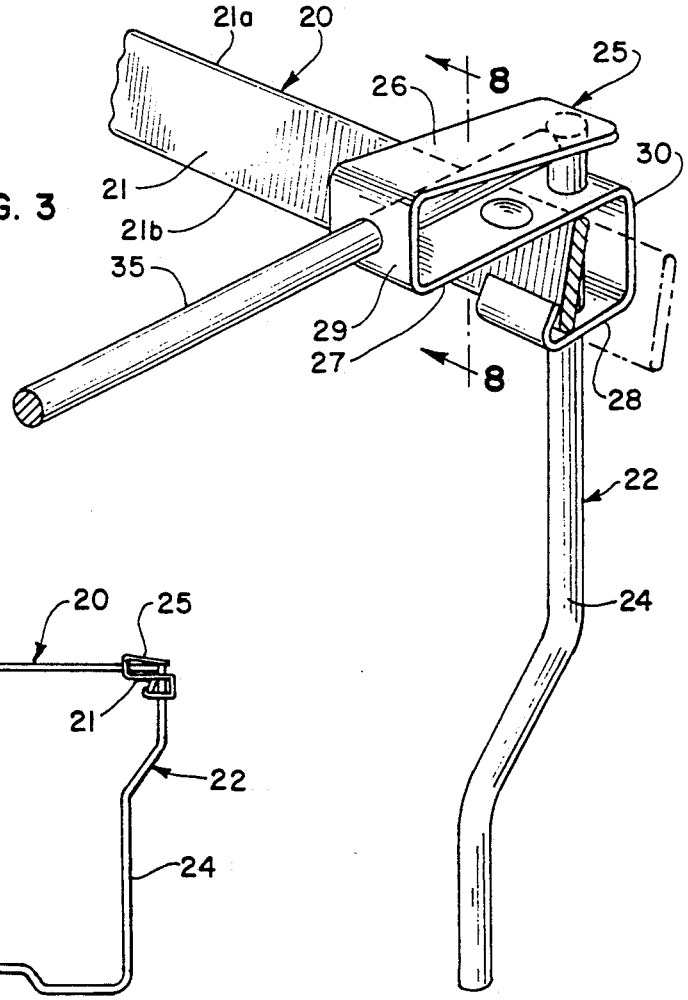
FIG. 3 is a perspective view of the spring clip as used with other elements of the assembly.
Figure 4:
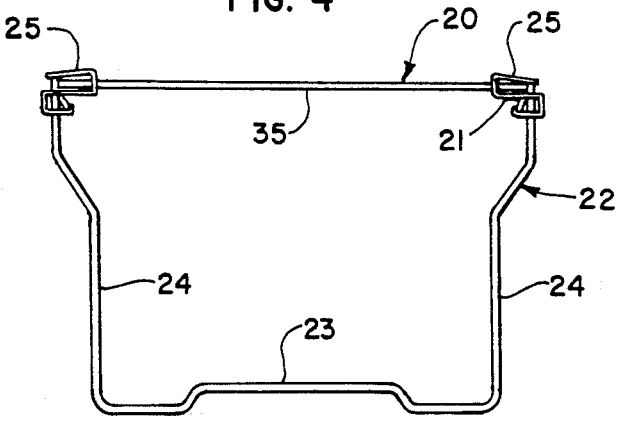
FIG. 4 is an end view of a file suspension assembly embodying the present invention.
Figure 5:
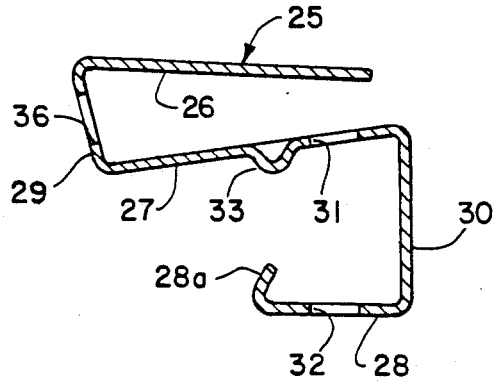
FIG. 5 is a cross sectional view of a clip taken along line 5—5 of FIG. 2.

Referring to the drawings, and particularly to FIGS. 3 and 4, the numeral 20 generally designates a file folder suspension assembly including a pair of spaced, parallel, and horizontal support rails 21. The rails are entirely conventional and may be formed from solid, flat strips of steel or other rigid metal or, alternatively, may be folded from sheet stock so that the rails are of double-layered metal construction. In any event, the rails are of uniform width and height and have rounded upper and lower edges 21*a* and 21*b*, respectively.

A U-shaped end frame 22 preferably formed of cylindrical bar stock is provided at opposite ends of the paired rails. Each end frame includes a horizontal lower bar 23 and a pair of integral upstanding side bars 24. The side bars as well as the lower bar may be provided with offsets as shown so that the end frame may be more effectively accommodated in any of the variety of file drawer designs that are currently available.

Figure 1:
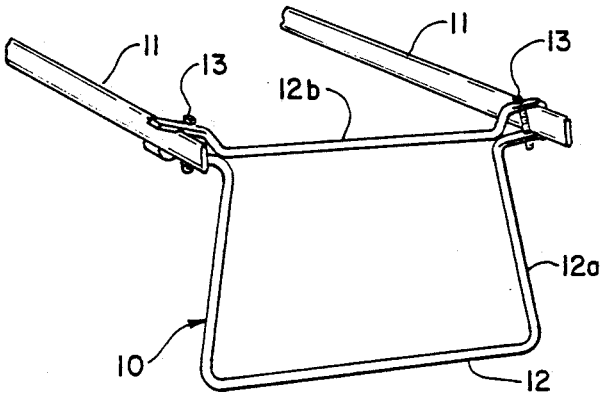
FIG. 1 Prior Art
FIG. 1 is a fragmentary perspective view of one end of a file suspension assembly known in the prior art.
Figure 2:
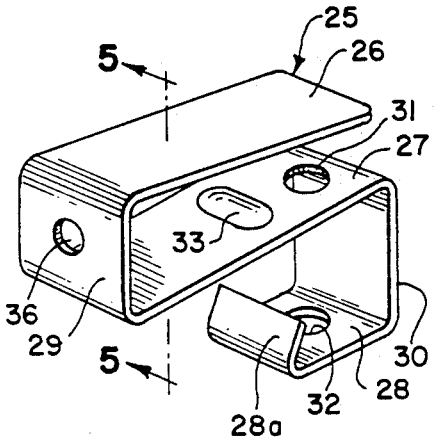
FIG. 2 is an enlarged perspective view of a spring clip constituting part of the present invention.

A spring metal clip 25 is provided at the upper end of each side bar 24, making a total of four such clips for the entire file folder suspension assembly. Each spring clip is generally S-shaped in configuration with top, intermediate, and base portions, 26, 27, and 28, respectively. The top and intermediate portions 26, 27 are joined by an integral upper connecting portion 29 and the intermediate and base portions 27, 28 are joined by an integral lower connecting portion 30 (FIG. 2). The clips are advantageously stamped from spring steel or other material having similar properties of strength and flexibility.

The intermediate and base portions 27 and 28 are provided with vertically aligned openings 31 and 32 for receiving the upper end of a side bar 24 of end frame 22. The openings are only slightly larger than the cross sectional dimensions of a side bar so that when the intermediate portion 27 and base portion 28 are flexed apart (FIG. 8) the edges defining the openings bear tightly against the outer surface of the bar and prevent sliding movement of the bar within the openings.

Figure 8:
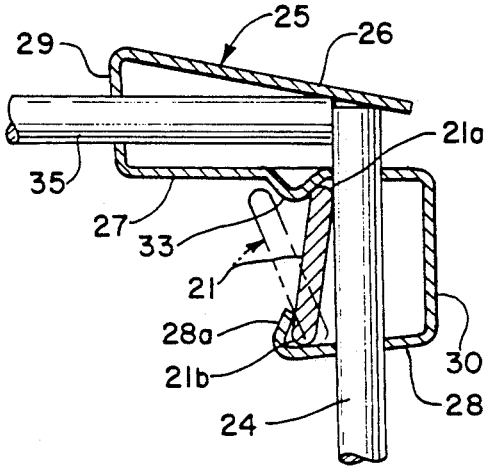
FIG. 8 is a fragmentary sectional view showing the complete corner assembly and taken along line 8—8 of FIG. 3.
Figure 6:
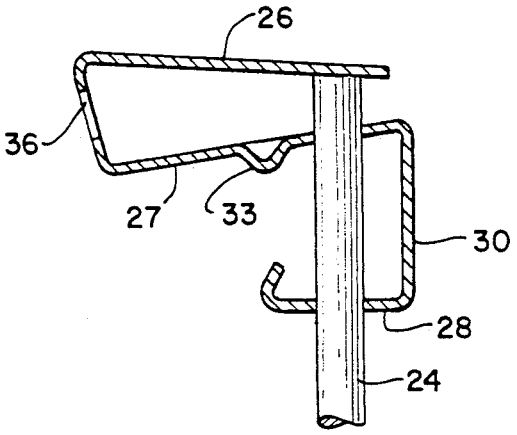
FIG. 6 is a sectional view similar to FIG. 5 but illustrating the insertion of a side bar into the aligned apertures of the clip.

The intermediate portion 27 and base portion 28 of each spring are flexed apart when a side rail 21 is forced therebetween as illustrated in FIG. 8. At its free end, the base portion is provided with an upturned flange 28*a* that serves to retain the lower edge 21*b* of rail 21. The intermediate portion 27 is dimpled or deformed to provide a downwardly-facing projection 33 spaced from opening 31 a distance that does not substantially exceed the thickness of rail 21. In assembling the parts, the upper end of side bar 24 is first inserted upwardly through the openings 32 and 31 of the clip and, thereafter, the rounded lower edge 21*b* of a rail 21 is fitted behind flange 28*a* and the rail is pivoted from the broken-line position into the solid line position depicted in FIG. 8 to force the free end of base portion 28 away from intermediate portion 27 and cause the spring clip to grip the rail tightly as well as securely engage bar 24.

In a preferred embodiment of the invention, each rail is supported in slightly inclined condition with its upper edge 21*a* bearing against side bar 24 and with its rounded lower edge 21*b* spaced from that side bar (FIG. 8). Such a relationship is advantageous because the weight of file folders carried by each rail then forces the rail more tightly against side bar 24 and in a direction opposite from the direction the rail must be pivoted when the parts are being disassembled.

Associated with each end frame 22, and constituting a part thereof, is a horizontal spreader bar 35. The bar 35 is preferably formed from straight cylindrical stock and the upper connecting portion 29 of each clip is provided with an opening 36 for receiving one end portion of the spreader bar. When an end portion of a spreader bar is fully inserted into the clip through opening 36, its end surface engages upstanding side bar 24. As shown most clearly in FIGS. 3 and 8, the top portion 26 of the clip extends over and preferably engages both the end portion of spreader bar 35 and the upper end of side bar 24. Ideally, the top portion of the clip must flex upwardly slightly, causing a slight pivotal action of upper connecting portion 29 which in turn causes the edges defining opening 36 to bite or securely engage the surface of spreader bar 35. Consequently, when the parts are fully assembled (FIGS. 3 and 8) each clip is in a state of tension and engages the other elements of the combination, namely, side bar 24, rail 21, and spreader bar 35 for securely holding the parts together.

It is believed apparent that the elements of the assembly may be easily and quickly connected without the use of tools following the steps depicted in FIGS. 5–8 of the drawings. First the clips 25 are fitted upon the upper ends of the side bars (FIG. 6), then the spreader rods are inserted (FIG. 7), and finally the side rails are fitted into place (FIG. 8).

Figure 9:
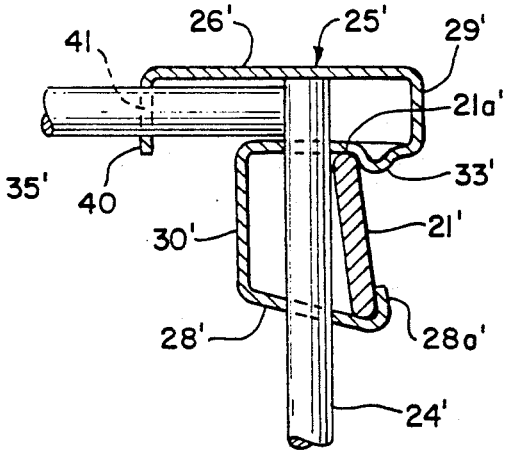
FIG. 9 is a cross sectional view of an assembly constituting a second embodiment of this invention.
Figure 7:
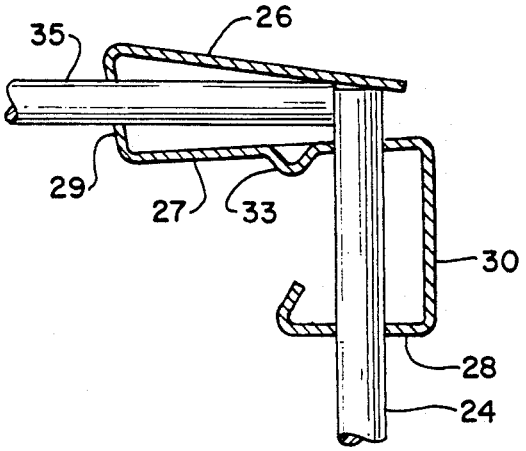
FIG. 7 shows the further step of inserting a spreader bar into the clip.

FIG. 9 depicts an alternate construction in which side rail 21' engages the opposite side of upstanding side bar 24' from the side engaged by spreader bar 35', in contrast to the construction of FIGS. 2–8 in which both the rail 21 and spreader bar 35 engage the same side of side bar 24.

Like spring clip 25, clip 25' is generally S-shaped and is provided with top, intermediate, and base portions 26', 27', and 28', respectively, with the top and intermediate portions joined by an integral upper connecting portion 29' and the intermediate and base portions joined by an integral lower connecting portion 30'. The side rail is secured between the intermediate and base portions of the clip in essentially the same manner previously described, with upstanding flange 28*a'* and projection 33' serving to hold the rail in inclined position with its rounded upper end 21*a'* bearing against upstanding bar 24'.

Clip 25' differs from clip 25 by reason of a depending flange 40 formed at the end of top portion 26'. The depending flange has an opening 41 through which the end portion of spreader bar 35' is inserted. Therefore, instead of being inserted through an opening in the upper connecting portion of the clip, as in the preceding embodiment, bar 35' extends through an opening 41 in depending flange 40. In both embodiments, the ends of the spreader bars engage the upstanding side rails and are covered or concealed by the top portions 26, 26' of clips 25, 25'.

While in the foregoing, I have disclosed embodiments of the invention in considerable detail for purposes of illustration, it will be understood by those skilled in the art that many of these details may be varied without departing from the spirit and scope of the invention.

I claim:

1. A file suspension assembly comprising a pair of file folder support rails; two end frames for supporting said rails at opposite ends thereof; and four flexible spring metal clips for joining said end frames to said ends of said rails at four corners of said assembly; each spring clip being generally S-shaped with top, intermediate, and base portions and with upper and lower connecting portions joining said top and intermediate portions, and said intermediate and base portions, respectively; said intermediate and base portions having a pair of vertically-aligned openings therethrough; each end frame including a pair of upstanding side bars with each side bar having an upper end thereof received in both of said vertically-aligned openings of one of said spring clips; each side rail having a vertical height slightly greater than the vertical distance between said base and intermediate portions of said clip when said clip is in an untensioned, unflexed state; and each end of each side rail being received between the intermediate and base portions of said clip with said portions being flexed apart under tension, and in firm contact with the upper end of a side bar extending through said aligned openings thereof, to cause said clip to securely engage both said rail and said side bar.

2. The assembly of claim 1 in which said upper end of each bar is disposed between one of said rails and said lower connecting portion of one of said clips.

3. The assembly of claims 1 or 2 in which said top portion of each clip projects over said upper end of one of said bars extending through said aligned openings.

4. The assembly of claim 3 in which said top portion of each clip engages said upper end of a side bar for limiting upward movement thereof relative to said clip.

5. The assembly of claim 2 in which said base portion of said clip has an upturned end flange engaging and retaining a lower edge of one of said bars between the clip's base and intermediate portions.

6. The assembly of claim 5 in which said intermediate portion of said clip includes a projection engaging said rail along an upper edge thereof for holding the same tightly against said side bar.

7. The assembly of claim 6 in which said rail slopes upwardly towards said side bar when said rail is viewed in cross section.

8. The assembly of claims 1 or 2 in which each end frame includes a horizontal spreader bar extending between and engaging the upper ends of said side bars; and means provided by said spring clips for receiving and retaining opposite ends of said spreader bar.

9. The assembly of claim 8 in which said means comprises an opening in said upper connecting portion of each spring clip for receiving one of said ends of said spreader bar.

10. The assembly of claim 9 in which said top portion of each spring clip extends over and forceably engages an end portion of said spreader bar.

11. The assembly of claim 8 in which said top portion of each clip has a downwardly-turned end flange; said means comprises an opening in said downwardly-turned end flange for receiving an end portion of said spreader bar.

12. The assembly of claim 11 in which said spreader bar and said rail engage opposite sides of each upstanding side bar.

13. A flexible spring metal clip for use in joining a side rail to an upstanding side bar of an end frame in a file folder suspension assembly, said clip being of generally S-shaped configuration with top, intermediate, and base portions and with upper and lower connecting portions joining said top and intermediate portions, and said intermediate and base portions, respectively; said intermediate and base portions having a pair of vertically-aligned openings therethrough of a size slightly larger than the cross section of a said side bar to be received therein; the vertical distance between said intermediate and base portions when said clip is unflexed being less than the cross-sectional height of a said side rail to be received therebetween so that flexure of said spring clip to receive and grip a said side rail between, said intermediate and base portions causes the edges defining said openings to tightly engage a said side bar extending therethrough.

14. The clip of claim 13 in which said top portion extends over said aligned openings of said intermediate and base portions.

15. The clip of claims 13 or 14 in which said base portion has an upturned end flange and said intermediate portion has a depending projection for engaging and retaining a said side rail.

16. The clip of claims 13 or 14 in which said upper connecting portion is provided with an opening therethrough for receiving the end of a spreader bar.

17. The clip of claim 13 in which said top portion has a depending end flange; said end flange having an opening therethrough for receiving the end of a spreader bar.

* * * * *